US009032872B2

(12) United States Patent
Uptergrove

(10) Patent No.: US 9,032,872 B2
(45) Date of Patent: May 19, 2015

(54) ROTARY SYSTEM AND METHOD FOR PRINTING CONTAINERS

(75) Inventor: Ronald L. Uptergrove, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 31 days.

(21) Appl. No.: 13/189,735

(22) Filed: Jul. 25, 2011

(65) Prior Publication Data

US 2012/0017783 A1 Jan. 26, 2012

Related U.S. Application Data

(60) Provisional application No. 61/367,218, filed on Jul. 23, 2010.

(51) Int. Cl.

| | |
|---|---|
| ***B41F 17/08*** | (2006.01) |
| ***B41F 15/12*** | (2006.01) |
| ***B65C 9/06*** | (2006.01) |

(Continued)

(52) U.S. Cl.

CPC ..... *B41J 3/4073* (2013.01); *B41F 17/30* (2013.01); *B41F 17/18* (2013.01); *B41J 3/407* (2013.01); *B41F 17/28* (2013.01); *B41P 2217/62* (2013.01);

(Continued)

(58) Field of Classification Search

CPC ..... B41F 17/08; B41F 17/14; B41J 17/16; B41J 17/18; B41J 17/20; B41J 17/28; B41J 17/30; B41J 2/01; B41J 11/002; B41P 2217/00; B41P 2217/61; B41P 2217/62

USPC ..... 101/35, 38.1, 39, 40, 40.1, 37; 347/4

See application file for complete search history.

(56) References Cited

U.S. PATENT DOCUMENTS 3,850,096 A * 11/1974 Taniguchi ..... 101/40
5,137,136 A 8/1992 Humele (Continued)

FOREIGN PATENT DOCUMENTS

DE 4228128 * 8/1992 ..... B05C 1/02
DE 19927668 * 12/2000 ..... B65C 9/06

(Continued)

OTHER PUBLICATIONS

US Commissioner of Patents; International Search Report and Written Opinion issued in corresponding International Application No. PCT/US2011/045160. Date of Mailing: Dec. 23, 2011.

*Primary Examiner* — Blake A Tankersley
*Assistant Examiner* — Marissa Ferguson Samreth
(74) *Attorney, Agent, or Firm* — Dykema Gossett PLLC

(57) ABSTRACT

A system for digitally printing directly on a plurality of containers is provided. In an embodiment, the system includes a device configured to determine an initial position or orientation of an individual container; a plurality of print heads configured to print directly on said containers; and a plurality of container holders configured hold or retain an individual container, to rotate the individual container, and to maintain a rotational position of the individual container relative to at least one print head while printing occurs; and one or more curing devices. The system may be configured such that the plurality of container holders are configured to move along a linear or curved path, and the plurality of container holders may be configured to controllably rotate about a container axis.

14 Claims, 6 Drawing Sheets

(51) Int. Cl.

| | |
|---|---|
| ***B41J 3/407*** | (2006.01) |
| ***B41F 17/30*** | (2006.01) |
| ***B41F 17/18*** | (2006.01) |
| ***B41F 17/28*** | (2006.01) |
| ***B41J 11/00*** | (2006.01) |

(52) U.S. Cl.
CPC ..... *B41P 2217/61* (2013.01); *B41P 2217/00* (2013.01); *B41J 11/002* (2013.01)

(56) References Cited

U.S. PATENT DOCUMENTS

| | | | | |
|---|---|---|---|---|
| 6,135,654 | A * | 10/2000 | Jennel | 400/61 |
| 6,164,199 | A | 12/2000 | Dubuit et al. | |
| 6,584,895 | B1 | 7/2003 | Strauch et al. | |
| 6,631,673 | B2 | 10/2003 | Aichele | |
| 6,684,770 | B2 | 2/2004 | Kamen et al. | |
| 6,769,357 | B1 * | 8/2004 | Finan | 101/38.1 |
| 6,857,359 | B2 | 2/2005 | Fujita et al. | |
| 6,920,822 | B2 | 7/2005 | Finan | |
| 6,948,425 | B2 | 9/2005 | Dumenil | |
| 6,962,110 | B2 * | 11/2005 | Hellmeier et al. | 101/44 |
| 7,013,624 | B2 | 3/2006 | Zwilling | |
| 7,478,660 | B2 * | 1/2009 | Sernesi et al. | 156/362 |
| 7,736,713 | B2 * | 6/2010 | Uptergrove | 428/35.7 |
| 7,905,174 | B2 | 3/2011 | Vetter et al. | |
| 7,997,201 | B2 * | 8/2011 | Till | 101/485 |
| 8,201,904 | B2 * | 6/2012 | Vesanto et al. | 347/9 |
| 8,215,756 | B2 | 7/2012 | Achhammer | |
| 8,256,854 | B2 | 9/2012 | Till | |
| 8,418,608 | B2 | 4/2013 | Preckel | |
| 2006/0144261 | A1 | 7/2006 | Uptergrove | |
| 2007/0039490 | A1 | 2/2007 | Aichele et al. | |
| 2007/0157559 | A1 * | 7/2007 | Till | 53/411 |
| 2009/0133593 | A1 | 5/2009 | Till | |
| 2010/0192517 | A1 | 8/2010 | Schach | |
| 2010/0257819 | A1 | 10/2010 | Schach | |
| 2011/0232514 | A1 | 9/2011 | Putzer et al. | |
| 2011/0233838 | A1 | 9/2011 | Kramer et al. | |
| 2011/0273726 | A1 | 11/2011 | Beckhaus | |
| 2012/0255450 | A1 | 10/2012 | Till | |
| 2013/0019566 | A1 | 1/2013 | Schach | |
| 2013/0037997 | A1 | 2/2013 | Voth | |
| 2014/0028771 | A1 | 1/2014 | Yamada et al. | |
| 2014/0049585 | A1 | 2/2014 | Tashiro et al. | |

FOREIGN PATENT DOCUMENTS

| | | | | |
|---|---|---|---|---|
| DE | 20115480 | * | 9/2001 | B65C 9/06 |
| WO | 2009018892 | * | 2/2009 | B41J 3/47 |
| WO | 2010081515 A2 | | 7/2010 | |

* cited by examiner

ROTARY SYSTEM AND METHOD FOR PRINTING CONTAINERS

CROSS-REFERENCE TO RELATED APPLICATIONS

This application claims the benefit of U.S. provisional application No. 61/367,218, filed Jul. 23, 2010, which is hereby incorporated by reference as though fully set forth herein.

TECHNICAL FIELD

The present invention relates to plastic containers having digital images printed thereon, including curved plastic containers.

BACKGROUND

Conventional techniques for printing onto curved plastic containers are subject to challenges. For example, it can be difficult to obtain proper registration between colors, and changing images, designs or wording can be expensive and time consuming.

Inkjet printing with multiple nozzles is often useful with flat surfaces. However, it can be difficult to satisfactorily use multiple nozzles on round, curved, and/or non-cylindrical print surfaces, particularly such surfaces when higher-speed operations are involved.

It is desirable to print a digitally generated image directly onto a plastic container, particularly a curved and/or non-cylindrical surface of a plastic container, wherein the printing can be accomplished with acceptable quality, and at a reasonable speed and cost.

SUMMARY

The present disclosure provides, inter alia, a system for digitally printing directly on a plurality of containers. In an embodiment, the system includes a device configured to fix or determine an initial position or orientation of an individual container; a plurality of print heads configured to print directly on said containers; a plurality of container holders, which may be configured hold or retain an individual container, to rotate the individual container, and to maintain a rotational position of the individual container relative to at least one print head while printing occurs; and one or more curing devices. The system may be configured such that the plurality of container holders are configured to move along a path (e.g., a curved or linear path), and the plurality of container holders may be configured to controllably rotate about a container axis. In some embodiments the system may be configured so that the containers are mechanically oriented, and may be self-orienting by mechanical means, with or without employing vision or scanning.

Further features and aspects of the present disclosure are discussed hereinbelow.

BRIEF DESCRIPTION OF THE DRAWINGS

The present invention will be more readily understandable from a consideration of the following illustrative drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention.

Figure 1:
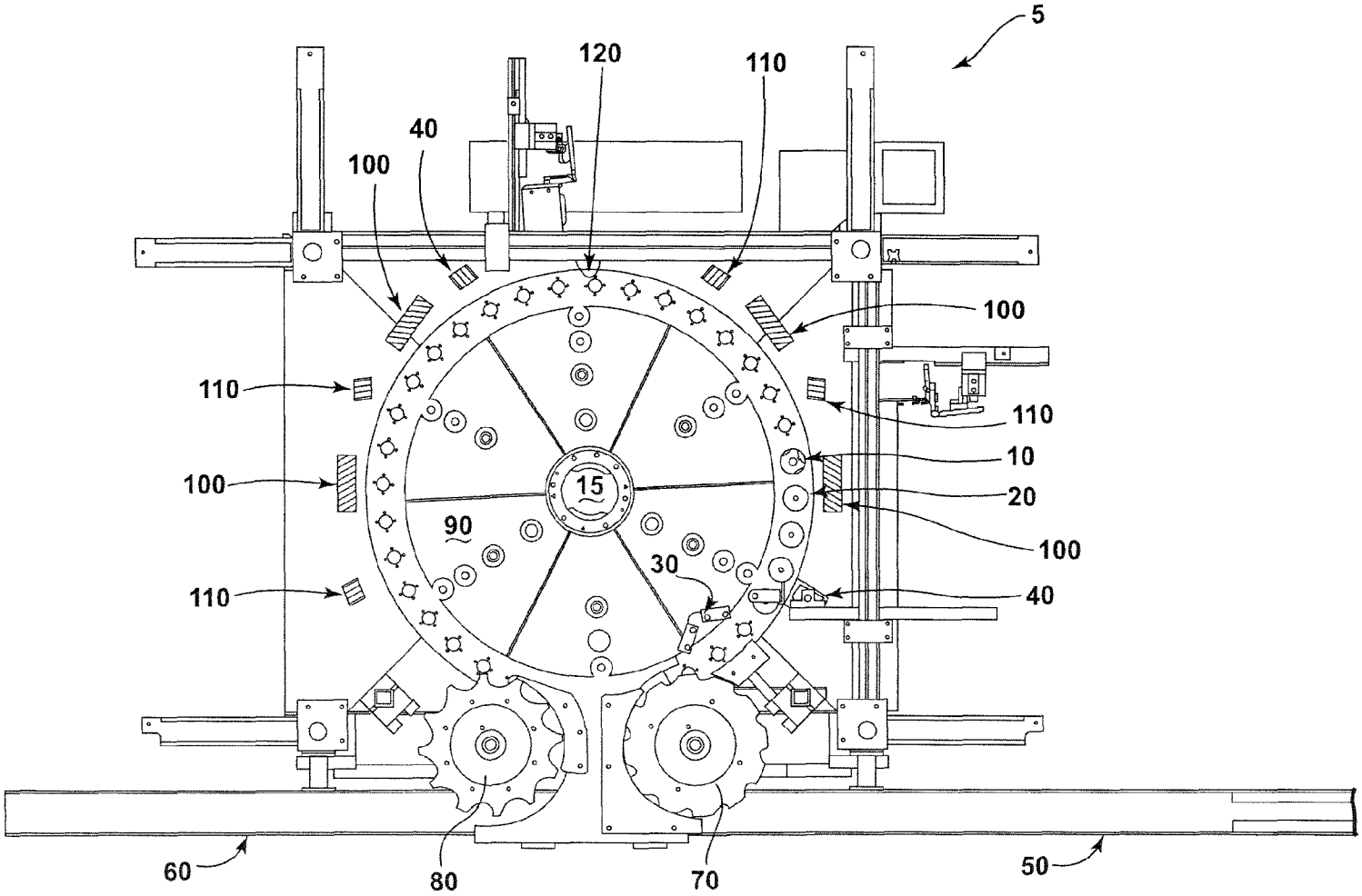
FIG. 1 is a top plan view of an embodiment of a rotary system embodying aspects of the present invention.

A top plan view of an embodiment of a rotary system 5 is generally illustrated in FIG. 1. The rotary system 5 is configured to print one or more digital images on a plurality of containers 10. As generally illustrated, the rotary system 5 may be configured to move the containers 10—for example, in a rotary or curved path—about or around a central rotary position (generally labeled 15). With embodiments of the disclosure, the rotary system 5 generally has an operational radius (e.g., a radius or curved path about a position, such as central rotary position 15) and the containers also have a radius (about a longitudinal axis of the individual container). Further, a radius associated with the surface of a container to be printed may be constant or non-constant. Embodiments of the rotary system 5 may be configured to account for both the system operational radius (which can generally be constant) and the container radius (which may be constant or non-constant), so that during printing a print head (which can be substantially stationary or movable) will have or maintain a substantially constant stand-off distance with respect to the surface of the container to be printed.

Figure 2:
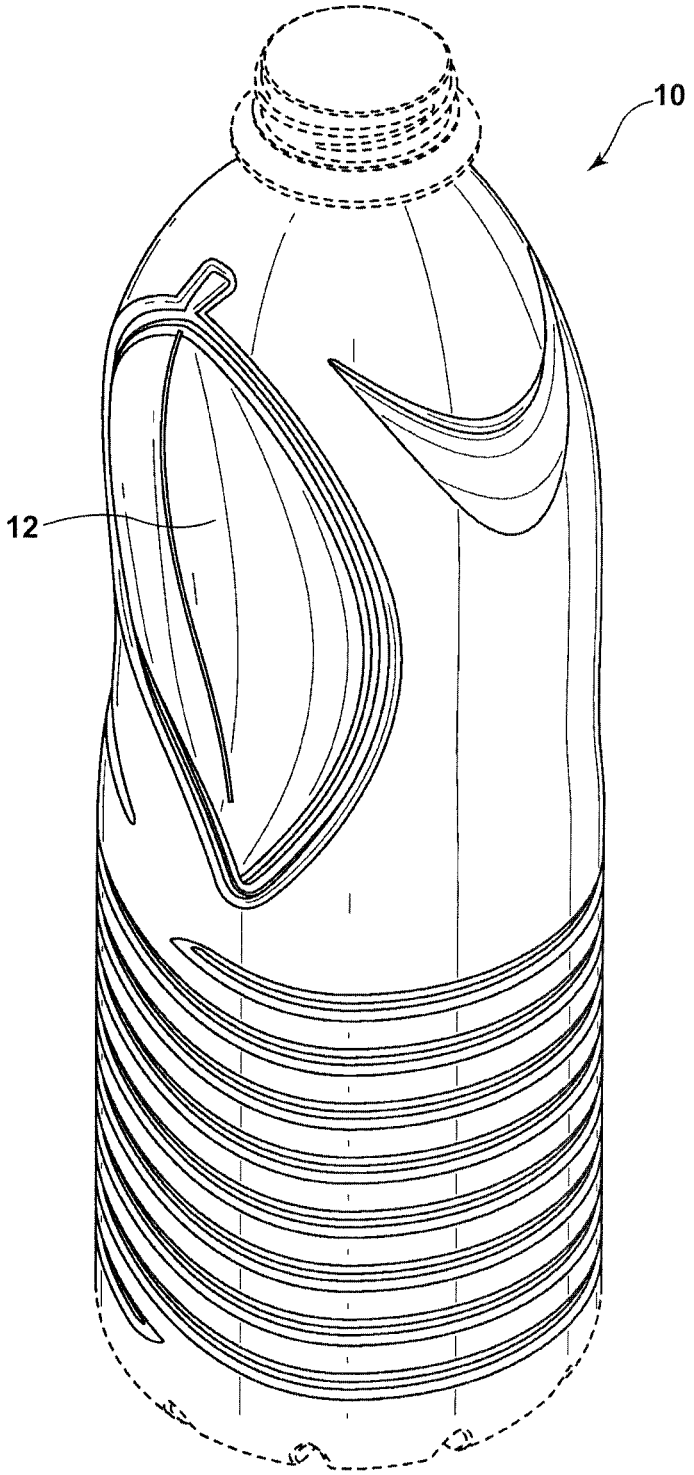
FIG. 2 is a* perspective view of an embodiment of a plastic container with a non-circular print surface.

By way of example and without limitation, an embodiment of a container that may be used in connection with the present disclosure is generally shown in FIG. 2. The illustrated container 10 includes portions that are non-cylindrical—e.g., the portion including a surface representation of a leaf 12. Without limitation, the container 10 may, for example, comprise a plastic injection molded or blow molded container. The container may also, without limitation, be comprised of a wide variety or monolayer or multilayer plastic materials, such as polyethylene terephthalate (PET) or high density polyethylene (HDPE).

In embodiments, the containers 10 may each be received within or otherwise retained by a container holder. The container holder 20 may be provided in a variety of forms, and may, if desired, comprise a base cup-type holder. For other embodiments of the rotary system 5, other portions of the container (e.g., upper/neck portion) may be held or retained—whether in addition to or in lieu of holding or retaining a base portion of the container. Without limitation, examples of base cup-type holders are generally shown as holders 20 in FIGS. 1 and 3. The container holder may simply hold or retain the container 10 during the printing operation associated with the system, or, if desired, the container holder may additionally provide supplemental processing associated with the base of the container, e.g., may provide heat or thermal shaping to portions of the container.

Figure 3:
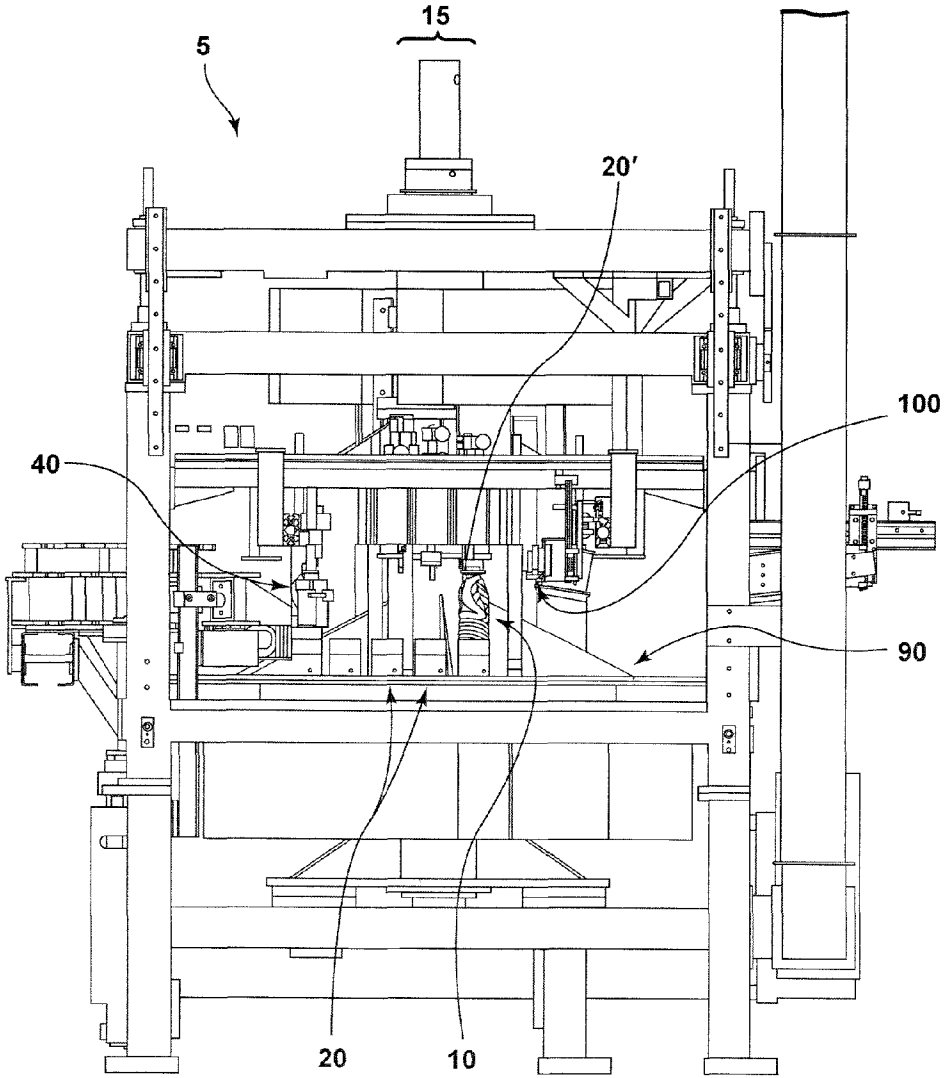
FIG. 3 is a side elevation view of a rotary system of the type generally illustrated in FIG. 1.
Figure 4:
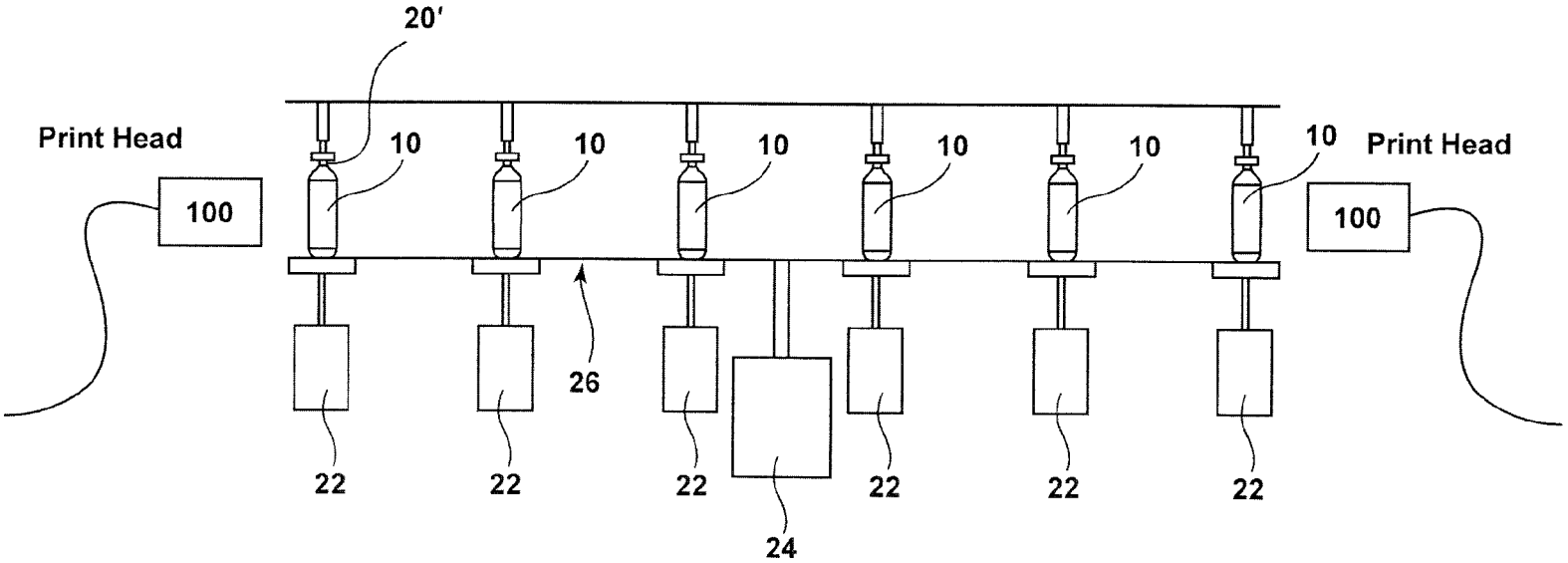
FIG. 4 is a side view of another embodiment of a rotary system.

In an embodiment, for example and without limitation, as generally illustrated in FIGS. 3 and 4, a container holder 20' may be configured to hold or retain a neck or an upper portion of a container 10. For instance, a container holder 20' may be configured to, instead of or in addition to engaging a base portion, engage a top of a neck and/or a flange portion of the container. A container holder 20' may, if desired, be configured to deliver the held or retained container to or into a lower holder (such as a cup-type holder, e.g., holder 20). As generally illustrated in FIG. 4, a container (e.g., container holder 20') may be connected to a servo motor (e.g., servo motor 22) and, for some embodiments, may further be configured to deliver a downward force on the container. As generally illustrated in FIG. 4, a servo motor may be associated with the rotation of an individual container about an axis, and a separate (commonly more powerful) servo motor 24 may be associated with a rotary wheel 26, which in turn is associated with the collective movement of a number of container holders (and hence containers).

In another embodiment, for example and without limitation, a container holder 20' may hold or retain a neck or an upper portion of a container. The container holder 20' may be configured to engage a top of a neck and/or a flange portion of the container, the container holder 20' may be connected to a servo, and no lower container holder (such as a container holder 20) may be required. In embodiments the container holder or holders, e.g., illustrated container holders 20 and/or 20' (which when more than one holder is employed in connection with a single container may be collectively referred to as a single "container holder"), may be configured to rotate 90 degrees or more. Further, embodiments of the system may employ a constant velocity or an indexed process. To print up to 360 degrees around the circumference of a container, the container may be positioned in front of an associated print head, and rotated up to 360 degrees in front of the print head.

As generally illustrated in FIG. 1, a rotary system 5 may include a plurality of container holders 20. Further, the plurality of container holders 20 may be configured to follow a curved or rotary path, and the container holders 20 may be further configured to rotate individual containers received within the container holder 20 about an axis. For embodiments, the axis about which the container holder 20 rotates may substantially correlate to a central longitudinal axis of an individual container 10. For other embodiments, the axis about which the container is rotated may instead correspond to the rotational axis of the container holder, which may not coincide with the axis of the container provided therein.

Rotary systems such as described herein may provide for direct printing (e.g., direct digital printing) on curved surfaces of containers at relatively high production speeds. However, alternative embodiments for a rotary system may be incorporated or employed. For example, and without limitation, a system may be configured so that containers move along a substantially linear path, and individual containers are rotated in front of one or more print heads/stations (e.g., about a central container axis) so as to provide or maintain a substantially constant distance or radius between the print head and the surface to be printed. In another embodiment of a system, a container path—at least in front of one or more print heads—may be configured with a radius or curved portion to facilitate providing a substantially constant distance between the print head and the print area on the container. It is noted that the print heads associated with the various disclosed embodiments may optionally be movable. Such movability can facilitate providing or maintaining a substantially constant distance (e.g., offset distance) between a print head and the print area or surface to be printed. Moreover, the ability to provide or maintain such a distance can be used in connection with non-round containers or containers that have surface portions with non-constant radii.

As generally shown in FIG. 1, an embodiment of the rotary system 5 may include a device configured to fix or determine an initial position and orientation of an individual container (e.g., an orientation lug registration device and/or a vision or scanning device 30), one or more pre-treatments devices 40, a supply mechanism (e.g., a supply conveyor 50), a receiving mechanism (e.g., a receiving conveyor 60), a supply wheel 70 (which may be associated with the supply mechanism), an exit wheel 80 (which may be associated with the receiving mechanism), a primary wheel 90, a plurality of print heads (or print stations) 100, and one or more curing devices (or curing stations) 110. In embodiments, it may be desirable to configure the plurality of print heads 100 so that their print path is substantially tangent to the path of the surface of the container to be printed. The line in FIG. 1 designated 120 generally represents the midpoint (180 degree point) of the rotary system 5.

It is additionally noted that with respect to ink delivery, where rotary movement is involved, the system may incorporate a compensation to address gravity and/or centrifugal forces (which may, for example, be a function of wheel speed). Force algorithms or curves may be used to adjust print head output to compensate for rotational speed and to prevent unintended discharge or drool from the print heads when spinning. For example, a force algorithm or curve may be employed to adjust meniscus pressure to compensate for rotational speed and to maintain a desired or acceptable meniscus at a print nozzle.

As mentioned, for some embodiments, the device configured to fix or determine an initial position and orientation of an individual container comprises a vision or scanning device 30. The device 30 may be configured to determine the position and/or orientation of each individual container 10. In embodiments, the vision or scanning device 30 may be positioned to "look" downward at the container. For example, without limitation, the vision or scanning system may look downward (e.g., through the opening of the container) and pick out a landmark or feature of the container (e.g., which may be a formation provided in the base portion of the container). In addition, or alternatively, particularly with containers that are retained by an upper container holder (e.g., container holder 20'), a vision or scanning system may be provided that "looks" upward at the container. The vision or scanning device may comprise various conventional systems as are known in the art. In embodiments, the vision or scanning device 30 may determine the position and/or orientation of the container as it enters the rotary system 5. For example, a container 10 may exit a supply wheel 70 and can be received within a container holder 20 associated with the primary wheel 90 of the rotary system 5.

As generally illustrated, a pre-treatment device 40 may provide a form of heat treatment to the containers. Such heating may be accomplished using known techniques including, without limitation, flame, forced air plasma, or corona heating/treatment processes. The curing device/station 110 may comprise a number of forms of curing devices including, for example, ultraviolet (UV) lamps (which may include LED components), radiation curing devices, and other known curing devices.

FIG. 3 is a side elevation view of a rotary system 5 of the type generally illustrated in FIG. 1. As generally illustrated, a container 10 may held or retained at a lower end of the container by a container holder 20. The container 10 may also be handled or secured at or about a container upper end, e.g., about an opening and/or via a container neck flange, by another container holder 20'. Together container holder 20 and container holder 20' comprising a collective "container holder" with respect to the container 10. In an embodiment, each container holder (for example, 20 and/or 20' as generally illustrated in FIG. 3) may be configured to rotate about a container holder axis such that the container holder can rotate to a desired extent. By way of example and without limitation, one or more container holders may be individually rotated by a servo mechanism such that the container holder, and consequently the held container, may be rotated to various desired degrees, up to and including 360 degrees or more. Further, by employing information obtained from the vision or scanning device, the orientation of each container 10 may be registered and controlled/adjusted in connection with the orientation of the container holder 20. For example, each container may be initially registered and, if appropriate, turned to a desired starting orientation for a given position in the system. By rotating the container holder 20, a desired portion of the surface of the container 10 may then be controllably presented to one or more devices (e.g., printing or curing) provided about the path of rotational movement of the primary wheel 90.

Figure 5:
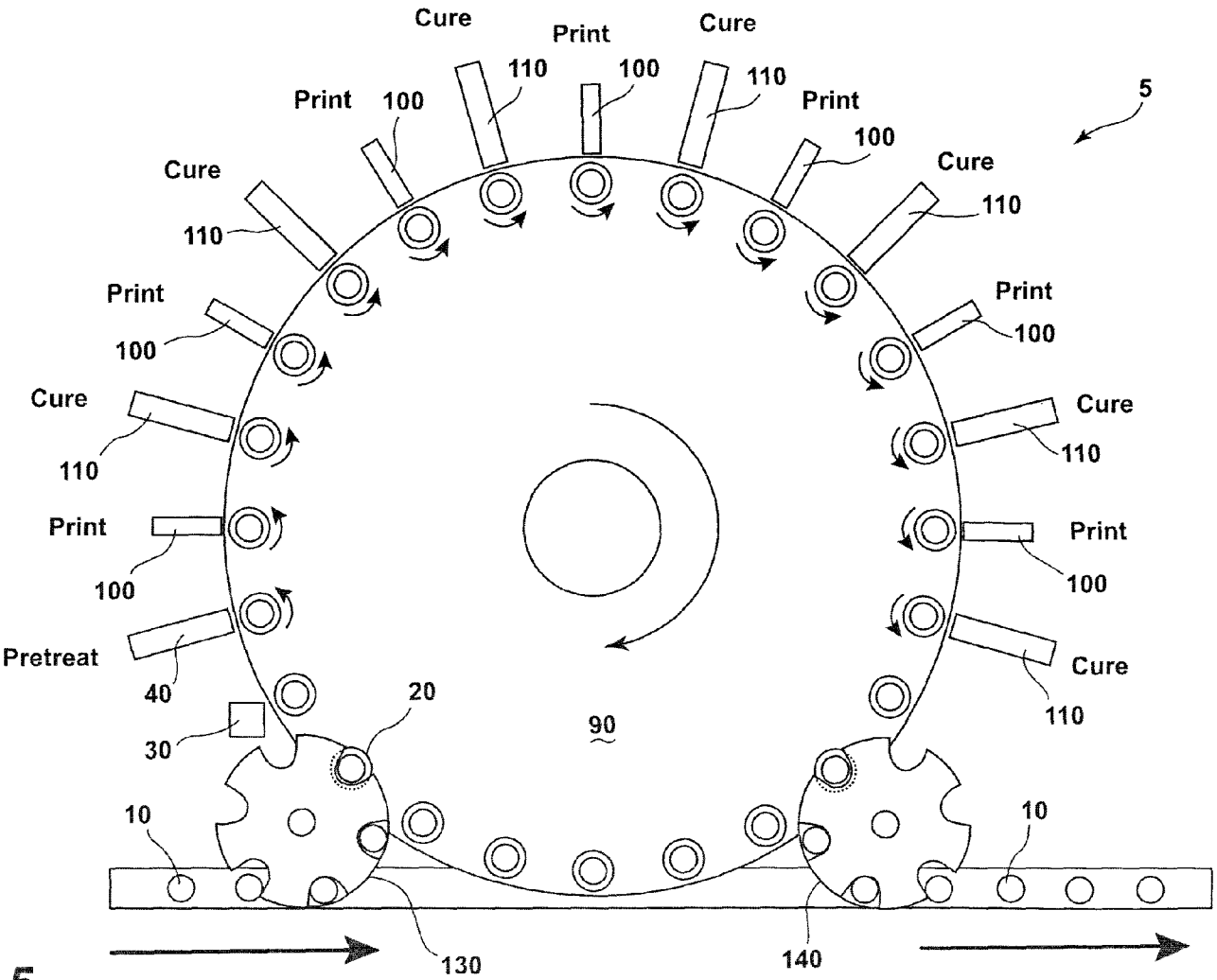
FIG. 5 is top plan view of another embodiment of a rotary system.

An example of a rotary system 5 generally illustrating features of the disclosure, including an indexing system/process, is shown in FIG. 5. As illustrated, the rotary system 5 may include a primary wheel 90, an input/supply wheel 130, a plurality of holders 20, a pre-treatment device 40, a plurality of print heads 100 configured to print directly on the containers 10, a plurality of curing devices 110, and an exit/output wheel 140. As indicated, the primary wheel can be configured to rotate in a clockwise direction, while the input/supply wheel 130 and the exit/output wheel can be configured to rotate in an opposing (e.g., counter-clockwise) rotational direction. As generally illustrated, the container holders 20 may be configured to rotate individual containers 10. In the illustrated embodiment, the container holders 20 are configured to rotate an individual container in a counterclockwise direction. A pre-treatment device 40, a plurality of print heads 100, and/or one or more curing devices 110 may be provided about the periphery of the primary wheel 90. For embodiments, the print heads may be substantially stationary with respect to the primary wheel 90. Although, for some embodiments a pre-treatment device 40, a plurality of print heads 100, and/or one or more curing devices 110 may be configured for movement, for example and without limitation, toward and away from the primary wheel 90. A device for fixing or determining an initial position and orientation of an individual container is generally shown as 30. In an embodiment of the illustrated system 5, the primary wheel can be configured for indexed rotational movement. For example, without limitation, containers may be brought to the primary wheel, and holders associated therewith, by an input/supply wheel 130. The container may be accepted by a holder and moved to index positions provided about the wheel and associated with various operations, e.g., pre-treatment, printing, and curing. At the site of each operation, the container/container holder may rotate so as to present a desired amount of rotational surface of the container to the operation. When the operation is completed, the rotation of the container can cease and the primary wheel can index to the next position. With some embodiments the printing and/or curing operations only occur while the rotation of the primary wheel is ceased and is properly positioned in front of the applicable operation.

Figure 6:
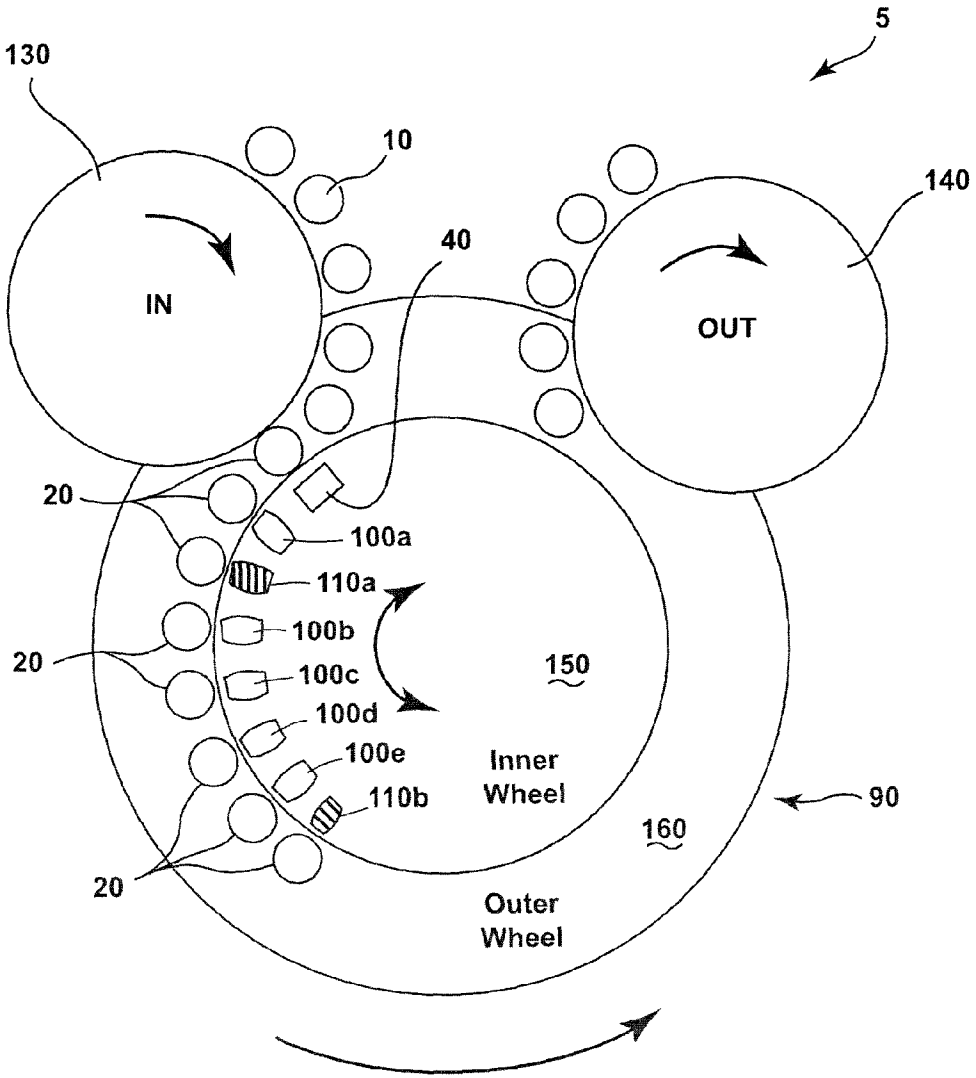
FIG. 6 is general representation of another embodiment of a rotary system.

Another example of an indexed system/process is generally illustrated in FIG. 6. As generally shown, the primary wheel 90 may comprise an inner wheel 150 and an outer wheel 160. The container holders 20, which may rotate about an axis, can be provided in connection with the outer wheel 160, while other operations (pre-treatment, printing, curing) may be provided in connection with the inner wheel 150. For example, with such a configuration, an inner wheel 150 with print heads 100*a*-100*e* could print and index back as the outer wheel 160 with the container holders (and the containers) turns. For instance, without limitation, in an embodiment, a first print head 100*a* may print a base coat (e.g., a white or clear base coat), the base coat may be cured 110*a*, and the container may be moved by a plurality of print heads printing colors (e.g., cyan 100*b*, magenta 100*c*, yellow 100*d*, black 100*e*), the one or more colors may then be individually or collectively cured 110*b*, and the process may be repeated with a subsequent container. As with the other embodiments, a device for fixing or determining an initial position and orientation of an individual container may be included with the system 5. The outer wheel 160 can be configured to generally rotate in a given rotational direction (e.g., counter-clockwise), and the inner wheel 150 can be configured to rotate both in the same direction as the outer wheel 160 (e.g., counter-clockwise), and "backwards" with respect to the outer wheel 160 (e.g., clockwise).

In an embodiment of the rotary system 5 such as illustrated in FIG. 6, the outer wheel 160 may be configured to rotate at a constant rotational velocity or speed, while the rotational velocity or speed and rotational direction of the inner wheel 150 can be changed or varied. For instance, when the inner and outer wheels are moved in the same rotational direction at substantially the same rotational velocity or speed (i.e., there is a rotational match or alignment), an operation can occur with respect to a container. That is, the container holder can present (i.e., rotate) the container for the applicable operation. Once the respective operation is completed, the speed and/or direction of the inner wheel 150 can be changed. For instance, a container can be loaded and a base coat can be printed thereon (while the direction and rotational speed of the inner and outer wheels substantially match). After the operation (e.g., printing of a base coat) is completed, the inner wheel 150 can rotate or index "backwards" to another/related operation (e.g., curing of the base coat), while the next bottle in succession is loaded and may undergo an operation just experienced by the preceding container (e.g., printing of a base coat). With such a system and process the inner wheel 150 can index back while the larger outer wheel 160 turns.

An embodiment of a method for printing on plastic containers is next generally described. A plurality of containers 10 are introduced to a rotary system 5. In an embodiment, the containers 10 may enter via a handling device such as a supply wheel 70. Each individual container 10 may be held or secured by a container holder 20. In an embodiment, a vision or scanning device 30 may "read" the container 10 and, using a feature or landmark associated with the container 10, and may register the position and/or orientation of the container with respect to the container holder 20 and/or the rotary system 5. In other embodiments, the container may be physically oriented, such as by an orientation lug or other means practiced in the field. The container holder 20 may then be registered or synchronized, and/or rotationally controlled to position the container in a desired position and/or orientation, e.g., a known or registered starting position. The container 10 will generally have a first side (e.g., side A) that faces radially outwardly (i.e., away from the central rotary position 15). For some applications, the container (e.g., side A) may initially be exposed to a pre-treatment (e.g., a pre-treating process). The primary wheel 90 may then rotate and the container may be exposed to a first print head/station 100, which may apply a first print (e.g., a first ink or first color), which may comprise a base coat. In embodiments such a base coat may be clear or white. If desired, the primary wheel 90 may further rotate to or provide alignment with a curing device/station 110 and the first print may be cured. The primary wheel 90 may then rotate to or align with a second print head/station and, if desired, a second print (e.g., a second ink or second color) may be applied (also generally to side A). The second print may then be cured in a manner as previously mentioned. The foregoing printing (or print-cure) steps may be repeated a number of times. At some point in the path of the primary wheel 90, the container holder 20 may be rotated (e.g., 180 degrees), which may expose a different "face" of the container (e.g., opposing side B), and the next successive rotary stations may repeat a process of printing (or print-cure). After the desired printing (or print-cure) steps have been accomplished, the container 10 may be directed from the system 5, for example, via an exit wheel 80.

The method and aforementioned system apparatus may be configured so as to be substantially customizable. For instance, the system 5 may be used with containers of different sizes and/or shapes. The system 5 may be programmed such that the rotations of the primary wheel and the container holders are coordinated/adapted for various sets or even individual containers, and particularly such that certain print portions or print "faces" of the container are provided substantially at tangents with respect to various stations provided in connection with the system. Among other things, the system 5 can account for or correlate the radii/path of the primary wheel 90 and the radii/spin of the containers 10 to optimize the time (in print zone) and/or positioning of the container surface for printing with respect to the associated stations. It is anticipated that embodiments of the system 5 can be configured to produce printed plastic articles (e.g., plastic containers) or any other generally cylindrical objects at rates equal to or in excess of 720 containers per minute. Moreover, in some embodiment, the printed articles may, instead or in addition to plastic, comprise glass, ceramic, or various metals.

In alternate embodiments of the rotary system 5, one or more print heads may be movable (e.g., radially inwardly-outwardly and/or vertically (up-down). Such print heads may be desirably articulated during the printing process to maintain a constant distance and perpendicularity from the container surface. Further, a plurality of sensors may be used to measure the curvature of the non-planar surface and/or control the articulation of the plurality of print heads to maintain the constant distance and perpendicularity from the non-planar surface.

Although numerous embodiments of this invention have been described above with a certain degree of particularity, those skilled in the art could make numerous alterations to the disclosed embodiments without departing from the spirit or scope of this invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A system for digitally printing directly on a plurality of containers in the form of plastic bottles, the system comprising:

an inner wheel and an outer wheel, the inner wheel and the outer wheel having a substantially common axis of rotation;

wherein the outer wheel is configured to generally rotate in a rotational direction, and the inner wheel is configured to rotate in the same rotational direction as the outer wheel and in a rotational direction opposite the rotational direction of the outer wheel;

a plurality of print heads provided on the inner wheel and configured to print directly on a side portion of each of said containers;

a plurality of container holders provided on the outer wheel, the holders are each configured to hold or retain an individual container, to rotate the individual container, and to maintain a rotational position of the individual container relative to at least one of the print heads while printing occurs; and one or more curing devices provided on the inner wheel and configured to cure a side portion of said containers;

wherein the plurality of container holders are configured to move along a holder path having a portion with a radius, the plurality of print heads are configured to move along an arcuate print head path, and the print heads are configured to print on said containers while said containers and the print heads are moving.

2. The system of claim 1, wherein the container holders are each configured to rotate an individual container about a container axis.

3. The system of claim 2, wherein each of the container holders is rotated by a servo motor.

4. The system of claim 2, wherein each of the plurality of container holders is configured to rotate 90 degrees or more.

5. The system of claim 2, wherein each of the plurality of container holders is configured to rotate 180 degrees or more.

6. The system of claim 1, wherein the plurality of container holders are configured to move along the holder path and rotate about a container axis simultaneously.

7. The system of claim 1, wherein the plurality of container holders are configured to rotate about a container axis when the containers are at a substantially stationary position along the holder path.

8. The system of claim 1, wherein the container holders move along the holder path, rotate the container about the container axis, or move and rotate said containers to an orientation position.

9. The system of claim 1, wherein said containers include a non-cylindrical surface and the system is configured to print on the non-cylindrical surface of said containers.

10. The system of claim 1, wherein the system further comprises a pre-treating device.

11. The system of claim 1, wherein the system is configured to maintain a substantially constant stand-off distance between the print heads and an outer surface of said containers to be printed.

12. The system of claim 1, wherein the inner wheel is configured to index and rotate in a direction opposing a rotational direction of the outer wheel.

13. The system of claim 1, wherein the outer wheel is configured to rotate at a substantially constant rotational speed.

14. The system of claim 1, wherein during printing a rotational speed of the inner wheel is configured to substantially match a rotational speed of the outer wheel.

* * * * *